US008006680B1

(12) United States Patent
Squire

(10) Patent No.: US 8,006,680 B1
(45) Date of Patent: Aug. 30, 2011

(54) MAGNETIC PAINT BALL GUN APPARATUS

(76) Inventor: Rob Squire, Andover, MN (US)

( * ) Notice: Subject to any disclaimer, the term of this patent is extended or adjusted under 35 U.S.C. 154(b) by 972 days.

(21) Appl. No.: 11/157,236

(22) Filed: Jun. 20, 2005

Related U.S. Application Data

(60) Provisional application No. 60/581,738, filed on Jun. 21, 2004.

(51) Int. Cl.
*F41A 9/61* (2006.01)

(52) U.S. Cl. ..... 124/50; 124/49

(58) Field of Classification Search ..... 124/49, 124/50, 71–77, 56
See application file for complete search history.

(56) References Cited

U.S. PATENT DOCUMENTS

| | | | | | |
|---|---|---|---|---|---|
| 2,182,369 | A | * | 12/1939 | Barron | 124/81 |
| 3,770,290 | A | | 11/1973 | Bottalico | |
| 4,314,623 | A | | 2/1982 | Kurokawa | |
| 4,432,441 | A | | 2/1984 | Kurokawa | |
| 4,468,883 | A | | 9/1984 | Williams | |
| 4,819,609 | A | | 4/1989 | Tippmann | |
| 4,936,282 | A | * | 6/1990 | Dobbins et al. | 124/74 |
| 5,017,819 | A | | 5/1991 | Patt et al. | |
| 5,063,905 | A | * | 11/1991 | Farrell | 124/72 |
| 5,074,189 | A | | 12/1991 | Kurtz | |
| 5,120,030 | A | | 6/1992 | Lin et al. | |
| 5,161,516 | A | | 11/1992 | Ekstrom | |
| 5,257,614 | A | | 11/1993 | Sullivan | |
| 5,280,778 | A | | 1/1994 | Kotsiopoulos | |
| 5,327,878 | A | | 7/1994 | Wittbrot | |
| 5,339,791 | A | | 8/1994 | Sullivan | |
| 5,349,939 | A | * | 9/1994 | Perrone | 124/76 |
| 5,460,094 | A | | 10/1995 | Ono | |
| 5,462,042 | A | | 10/1995 | Greenwell | |
| 5,494,024 | A | | 2/1996 | Scott | |
| 5,497,758 | A | * | 3/1996 | Dobbins et al. | 124/73 |
| 5,505,188 | A | * | 4/1996 | Williams | 124/74 |
| 5,515,838 | A | | 5/1996 | Anderson | |
| 5,564,747 | A | | 10/1996 | Ono et al. | |
| 5,572,982 | A | * | 11/1996 | Williams | 124/74 |
| 5,630,406 | A | | 5/1997 | Dumont | |
| 5,673,679 | A | * | 10/1997 | Walters | 124/53.5 |
| 5,727,538 | A | * | 3/1998 | Ellis | 124/77 |

(Continued)

OTHER PUBLICATIONS

"E-mag Exploded View", emagexploded.pdf, from http://www.airgun.com/downloads/emagexploded.pdf, Apr. 16, 2004, 49 pages, AirgunDesigns, Inc.

(Continued)

*Primary Examiner* — Troy Chambers
*Assistant Examiner* — Jonathan C Weber
(74) *Attorney, Agent, or Firm* — Albert W. Watkins

(57) ABSTRACT

A paint ball gun barrel indexing pin includes a plunger, cover, body, and first and second magnets that bias the plunger within the barrel. Magnetic coupling is used between rigid components that are used to position paint balls within a paint ball gun. In a "push-push" arrangement, a pair of magnets are oriented with like poles facing each other. When force is applied to one of the pair of magnets, the force will be transmitted through the magnetic fields to the second magnet. This magnetic coupling offers low resistance to movement when the magnets are in an initial substantially spaced apart relationship. Such low force coupling ensures gentle handling of the paint balls. However, as the limits of travel are approached, the magnetic coupling will exponentially increase forces between the magnets, preventing a "bottoming out" of the coupling.

16 Claims, 6 Drawing Sheets

U.S. PATENT DOCUMENTS

| | | | | |
|---|---|---|---|---|
| 5,778,868 | A * | 7/1998 | Shepherd | 124/76 |
| 5,791,325 | A * | 8/1998 | Anderson | 124/56 |
| 5,947,100 | A * | 9/1999 | Anderson | 124/45 |
| 6,062,208 | A * | 5/2000 | Seefeldt et al. | 124/71 |
| 6,273,080 | B1 | 8/2001 | Sullivan, Jr. | |
| 6,439,217 | B1 | 8/2002 | Shih | |
| 6,474,326 | B1 * | 11/2002 | Smith et al. | 124/77 |
| 6,516,791 | B2 | 2/2003 | Perrone | |
| 6,520,172 | B2 | 2/2003 | Perrone | |
| 6,526,685 | B2 | 3/2003 | Tippmann, Jr. | |
| 6,561,176 | B1 | 5/2003 | Fujimoto et al. | |
| 6,568,381 | B2 * | 5/2003 | Chang | 124/32 |
| 6,618,975 | B1 * | 9/2003 | Shih | 124/73 |
| 6,637,421 | B2 * | 10/2003 | Smith et al. | 124/77 |
| 6,644,294 | B2 * | 11/2003 | Christensen | 124/77 |
| 6,668,478 | B2 | 12/2003 | Bergstrom | |
| 7,156,084 | B1 * | 1/2007 | Landis | 124/50 |
| 2001/0003802 | A1 | 6/2001 | Vitale | |
| 2002/0088449 | A1 * | 7/2002 | Perrone | 124/74 |
| 2003/0106545 | A1 * | 6/2003 | Verini | 124/74 |
| 2003/0168052 | A1 * | 9/2003 | Masse | 124/73 |
| 2005/0145235 | A1 * | 7/2005 | Jong | 124/73 |
| 2005/0188973 | A1 * | 9/2005 | Monks | 124/42 |
| 2006/0005825 | A1 * | 1/2006 | Monks | 124/77 |
| 2007/0131209 | A1 * | 6/2007 | Campo et al. | 124/56 |
| 2007/0215135 | A1 * | 9/2007 | Campo | 124/77 |
| 2008/0127957 | A1 * | 6/2008 | Campo | 124/32 |

OTHER PUBLICATIONS

"Toxic Magnetic Trigger Frame for Matrix", from http://www.warpig.com/paintbal/technical/misc/toxicmagframe/index.html, Apr. 13, 2004, 3 pages Warpig.

Small Parts Shocker Base, http://paintballerz.com/Scripts/prodVies.asp?idProduct=466 , 2003, 2 pages, Paintballerz.com.

"Owners Manual for Ranger Series", http://www.armyoforr.com/images/Downloads/RangerManual.pdf, May 18, 2004, 19 pages, Worr Game Products.

"Lapko Paintball Products Wholesale", http://www.lapcopaintball.com/autococker.html, May 18, 2004, 2 pages, LAPCO Paintball Products.

"Eclipseblade" Operating Manual, http://www.armyoforr.com/images/Downloads/eBladeBook.pdf, Apr. 16, 2004, 79 pages, Planet Eclipse Ltd.

The Phantom Online,http://www.phantomonline.com/, May 18, 2004, 2 pages, Component Concepts, Inc.

"New Reverse Polarity Magnetic Trigger Kit for the Intimidator", http://www2.criticalpaintball.com/product_info.php/products_id/67?osCsid=af2c267956dc9f38daad5b520260978b, Apr. 13, 2004, 2 pages, Critical Paintball.com.

"E-Class Orracle Autococker by WGP", http://www.madcocker.com/detail.asp?AwID=121&CategoryID=, Apr. 14, 2004, 2 pages, Critical Paintball.com. Dark Side Games, Corp.

* cited by examiner

MAGNETIC PAINT BALL GUN APPARATUS

CROSS REFERENCE TO RELATED APPLICATIONS

This application claims priority to U.S. provisional patent application Ser. No. 60/581,738 filed Jun. 21, 2004 and entitled "Magnetic Paint Ball Gun Cartridges" by the present inventor, the contents which are incorporated herein by reference in entirety.

BACKGROUND OF THE INVENTION

1. Field of the Invention

This invention pertains generally to mechanical guns and projectors, and more specifically to magnetic couplings which offer improved interaction with and operation of paint ball guns. In specific manifestations, magnetic couplings are provided for paint ball indexing, gas valve coupling, magnetically coupled bolts, and custom triggers.

2. Description of the Related Art

Paint ball guns have enjoyed much popularity for a number of years. The sport offers the challenge and intrigue of competitions and battles that stimulate a person's consciousness. However, unlike actual wars, hunts and the like, the combatants may return day after day to continue to test and refine their skills.

In a paint ball competition, the paint balls themselves are designed to be propelled by a gun which uses pressurized gas as the propellant. The paint ball is designed to withstand normal movements inside of the gun, while being sufficiently frangible to break upon impact, subsequent to being propelled. When the paint ball strikes a competitor, it will break and mark the person who has been hit. Consequently, the ball must also be sufficiently soft to not cause harm to the person, though it is understood that in most competitions the person will be wearing basic protective gear such as goggles and the like to protect body parts which would otherwise be too easily harmed.

Modern paint balls are typically comprised of gelatinous compounds which offer both the necessary toughness to survive gun use and the rupture strengths that are low enough to lead to breakage on impact. Unfortunately, it is also known that many factors can affect the characteristics of the paint ball outer membrane, including but not limited to such diverse factors as temperature, humidity, manufacturing tolerances, production or post-production handling, and the like.

Since the paint ball must be sufficiently soft and frangible to not harm the competitors, and to reliably break upon impact, and since there are unpredictable factors that may weaken the ball, a paint ball gun must be designed to handle the paint balls as gently as possible. Otherwise, paint balls may break inside the gun, even prior to firing. When a paint ball does break, the gun may be disabled until the competitor cleans out both the paint and the gelatin capsule. When this occurs deep inside the gun, the time required for cleaning may be too great, leaving the competitor defenseless against another competitor. Consequently, it is highly desirable to have the most reliable handling of paint balls within the gun possible.

A typical paint ball gun must receive a single paint ball and position the ball into the breech. Subsequently, the gun will expel the ball using a blast of pressurized gas. The source of paint balls is typically a magazine, which will hold a plurality of paint balls therein. The magazine in turn couples to the gun just ahead of a bolt, and typically at an angle offset from parallel to the gun barrel.

To ensure a single paint ball is placed into the breech, a bolt travels parallel to the gun barrel, and in a first position permits a single paint ball to pass down into the path parallel to the barrel. Next, the bolt will travel forward, both moving the paint ball forward into the breech and simultaneously blocking the passage of any additional paint balls from the magazine into the barrel region. The bolt additionally blocks backflow of propellant into the magazine feed path. This handling of the paint ball by the bolt is one of several critical controlled movements that are made by a paint ball gun, often in very small fractions of a second.

In order to prevent more than one paint ball from being loaded into the breech per cycle, or from simply rolling out of the barrel accidentally, some type of barrel restriction is typically applied. Exemplary apparatus include rings within the barrel that are smaller than diameter of the paint ball, elastomer and polymer projections into the paint ball path, and barrel sections selectable based upon paint ball size to properly compress the paint ball during firing. The use of a spring-button cartridge for holding paint balls in place in the barrel is exemplified in U.S. Pat. No. 5,727,538 by Ellis, entitled "Electronically actuated marking pellet projector", the teachings which are incorporated herein by reference. Patents which illustrate other related devices, the teachings which are incorporated herein by reference, include U.S. Pat. No. 5,327,878 by Wittbrot, entitled "Device for holding spherical projectiles"; U.S. Pat. No. 5,280,778 by Kostsiopoulos, entitled "Semi-Automatic firing compressed gas gun"; U.S. Pat. No. 5,515,838 by Anderson, entitled "Paint ball gun"; U.S. Pat. No. 6,273,080 by Sullivan, Jr., entitled "Paint ball gun barrel with multiple compression zones"; and U.S. Pat. No. 6,516,791 and U.S. Pat. No. 6,520,172 by Perrone.

In addition to the proper handling of paint balls, it is also highly desirable to provide other reliable mechanisms within the gun, which may preferably be customized easily and, where practical, without tools.

SUMMARY OF THE INVENTION

Exemplary embodiments of the present invention solve inadequacies of the prior art by providing magnetic coupling between rigid components used to move paint balls about within a paint ball gun. In a "push-push" arrangement, a pair of magnets are oriented with like poles facing each other. When force is applied to one of the pair of magnets, the force will be transmitted through the magnetic fields to the second magnet. In several of the embodiments, this magnetic coupling offers low resistance to movement when the magnets are in an initial substantially spaced apart relationship. Such low force coupling ensures gentle handling of the paint balls. However, as the limits of travel are approached, the magnetic coupling will exponentially increase forces between the magnets, preventing a "bottoming out" of the coupling. In other embodiments, magnetic coupling is used to replace prior art mechanical components, to provide synergy not heretofore available.

In a first manifestation, the invention is a paint ball gun barrel indexing pin. The pin includes a plunger, cover, body, and first and second magnets. The plunger passes within a hole and is variable in position relative therewith. The cover retains the plunger within the hole and thereby defines a first limit of travel. The body retains the plunger within the hole and thereby defines a second limit of travel distal to the first limit of travel. A first magnet is coupled to the cover. A second magnet is coupled to the plunger. The first and second magnets is combination repel the plunger from the cover towards the second limit of travel.

In a second manifestation, the invention is, in combination, a paint ball gun barrel, a paint ball, and a means for controlling a position of the paint ball within paint ball gun barrel. The improvement comprises a floating paint ball face suitable for contacting and moving the paint ball, a means for limiting a position of the paint ball face, and a magnetic coupling between the limiting means and the floating paint ball face.

In a third manifestation, the invention is a poppet-style gas valve for a paint ball gun having a valve seat biased closed by magnetic repulsion and opened by a hammer. The magnetic repulsive force increases by a square exponential function as the valve is increasingly opened.

In a fourth manifestation, the invention is a trigger for activating a device through limited motion within a groove. The trigger has a trigger receiver having at least one magnetically susceptible material and a trigger face having a geometric shape suitable for manual activation and having at least one magnetically susceptible material. The trigger face magnetically susceptible material generates sufficient magnet force with the trigger receiver magnetically susceptible material to operatively mechanically couple the trigger face to the trigger receiver.

OBJECTS OF THE INVENTION

A first object of the invention is to improve the handling of paint balls within a paint ball gun, to reduce the likelihood of the paint ball breaking during such handling. A second object of the invention is to enhance the reliability of operation of the paint ball gun. Another object of the present invention is to achieve the foregoing objectives using components and apparatus which directly substitute for or replace less effective or reliable prior art components. A further object of the invention is to reduce the complexity of the paint ball gun, while achieving the foregoing objectives. Yet another object of the invention is to permit adjustment, where possible, of the forces applied to a paint ball by the gun during various operations.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides magnetic coupling for components that have not heretofore been so coupled, and which offer substantial synergy and benefit not heretofore contemplated.

Figure 1:
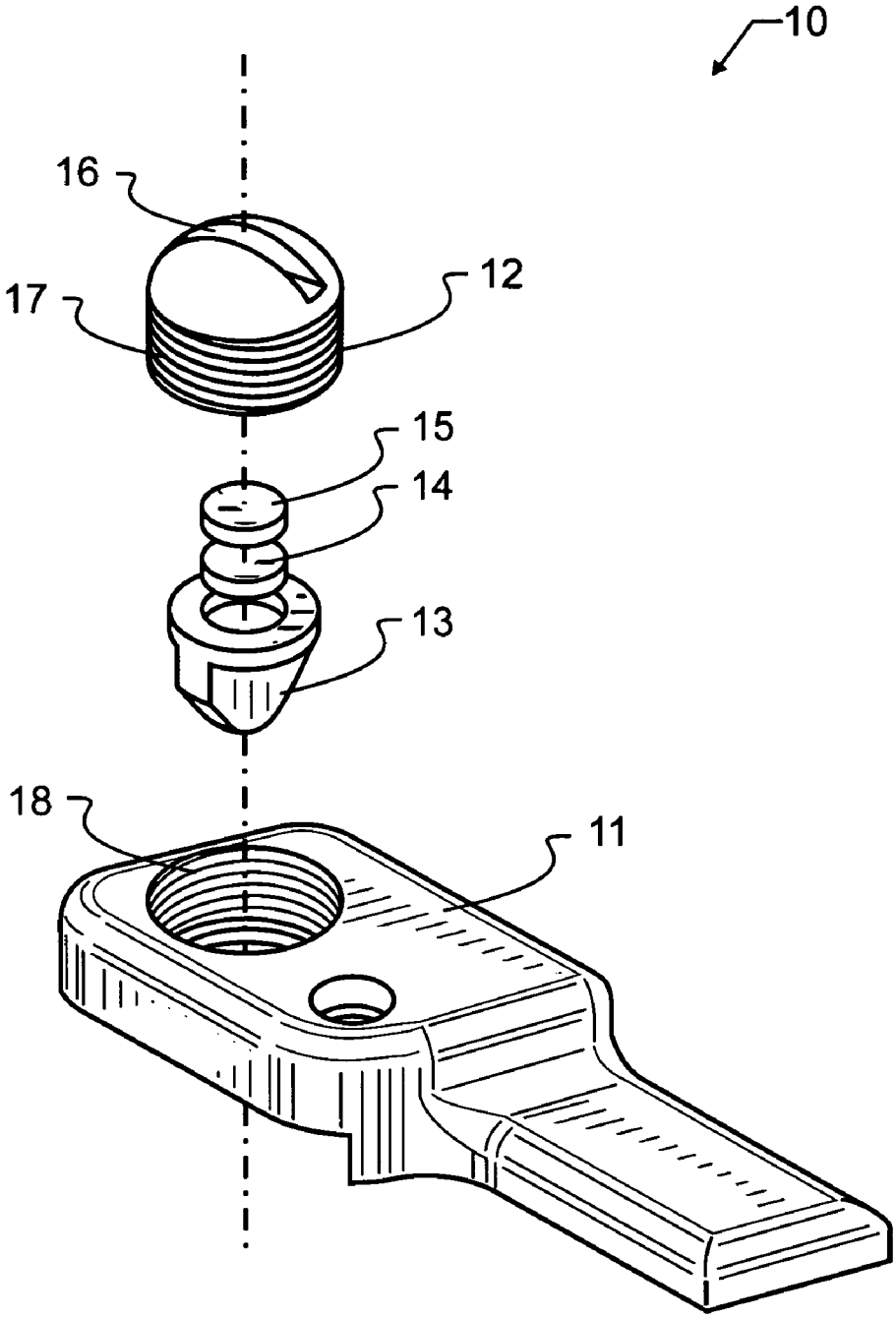
FIG. 1 illustrates a preferred embodiment barrel indexing pin designed in accord with the teachings of the present invention from an exploded and projected assembly view.

A most preferred embodiment pin 10 designed in accord with the teachings of the invention is illustrated in FIG. 1. This pin 10 is designed for optimal operation in the barrel of a paint ball gun. As will be known by those familiar with the paint ball gun operation, it may be possible for a paint ball in some instances to inadvertently escape the barrel, or to undesirably migrate towards the open barrel end if not otherwise restricted. The loss of an individual paint ball is relatively minor from an economic standpoint. However, the potential misfire from a mis-positioned ball or the lack of firing during a competition can be most undesirable. The lack of a ball properly placed in the barrel may cause the participant to miss a very important, potentially irreplaceable competitive opportunity.

In the most preferred embodiment pin 10 illustrated in FIG. 1, a cap 12 has external threading 17 most preferably designed to engage a threaded bore 18, which in the preferred embodiment is formed into a plate 11 that is in turn coupled to a bore formed into the barrel of a paint ball gun. Cap 12 and plate 11 will form a seal securely with the paint ball gun barrel. The orientation of threads, and even the specific use of threads instead of other methods of attachment will be determined by a suitably skilled designer for a specific application and those skilled in the art will recognize that different arrangements may be made, and that other types of connectors selected from the myriad of possible connectors are considered to be included herein.

As illustrated, cap 12 carries a magnet 15 therein, preferably of the rare earth type which is known to provide substantial magnetic flux with only minimal mass, though the invention will be understood to not be solely limited to rare earth magnets. A plunger 13 is provided within threaded bore 18 in plate 11, and reciprocates therein without interference. At an end of plunger 13 most adjacent cap 12 is a rare earth magnet 14 similar to magnet 15 in cap 12. Most preferably, magnets 14 and 15 will have like poles facing each other, which causes the magnets to repel each other. In turn, plunger 13 will be driven away from cap 12 and into the paint ball gun barrel bore. When properly dimensioned, plunger 13 will extend sufficiently into the barrel bore to interfere with a minimally dimensioned paint ball, and thereby prevent the paint ball from passing through the barrel beyond the preferred pin 10.

It will be recognized that much benefit may be attained with this preferred pin 10 over the prior art. Most importantly, all paint balls may be reliably retained as desired. In the event of a firing accident or defective ball, which is known to result in the breaking of the paint ball, paint will be released into the gun barrel. This paint will undoubtedly coat any device designed to retain the paint balls, and will consequently interfere excessively with proper operation. In such case, the interfering section must somehow be cleaned. Where the barrel itself provides the necessary interference, it will be apparent that there may be frequent need to clean the entire barrel. With the present pin, the pin itself may be removed more readily, using a screwdriver engaging in slot 16, than the cleaning of an entire barrel. Furthermore, the few components illustrated herein may be readily cleaned. For instance, in such case where magnets 14, 15 are molded directly into associated structure (i.e.—molded directly into cap 12 and molded directly into plunger 13) the person in the field must only worry about the three components, which are plunger 13, plate 11, and cap 12. Field cleaning and replacement is a relatively simple matter, and rarely required owing in part to the general self-cleaning nature of plunger 13. Magnets such as magnets 14 and 15 are readily cleaned, especially encapsulated magnets, while a spring as found in the prior art is very difficult to clean and must instead frequently be replaced.

While the simplified field cleaning, replacement, and relatively higher reliability than the prior art are both very desirable and beneficial, another beneficial feature of the invention exists in the reduced breakage which may be achieved by the present invention. The use of magnets 14, 15 to bias plunger 13 into the gun barrel results in only a minimal force being applied when plunger 13 is in a most interfering position. Magnetic force is calculated as an inverse square function of distance. In contrast, ordinary springs operate with force as a linear function of distance. As a result, there is less force required to move the paint ball past plunger 13 within a paint ball gun barrel using magnets 14, 15. However, when the two magnets are moved into nearly adjacent position, resulting during firing when plunger 13 is driven from the barrel towards cap 12, the magnetically induced forces will increase more rapidly in magnitude than a spring would, and will help prevent plunger 13 from slamming against cap 12 or damaging any component.

As an additional feature and advantage, the preferred embodiment pin 10 is adjustable in force, using one of several different techniques. For more minor adjustments in force, cap 12 may be screwed farther into bore 18 or farther out. Such movement will either increase or decrease the distance between magnets, which will in turn increase or decrease forces of repulsion, respectively. Where greater increases in forces are desired than may be achieved by screw adjustment, more magnet mass or more powerful magnets may be inserted into cap 12. As but one example, one or more additional magnets of like size and geometry to magnet 15 may be inserted into cap 12, so long as provision is made in the geometry of cap 12 for the same. Conversely, fewer, smaller or weaker magnets can be used to decrease the force more than could be attained by screw adjustment.

Figure 2:
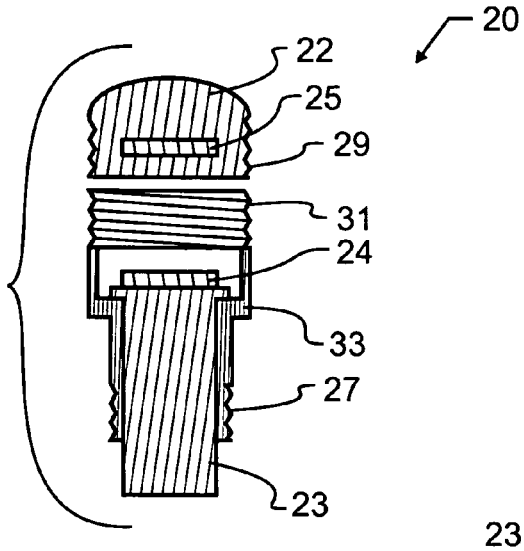
FIG. 2 illustrates a first alternative embodiment barrel indexing pin designed in accord with the teachings of the present invention from cross-sectional view.
Figure 3:
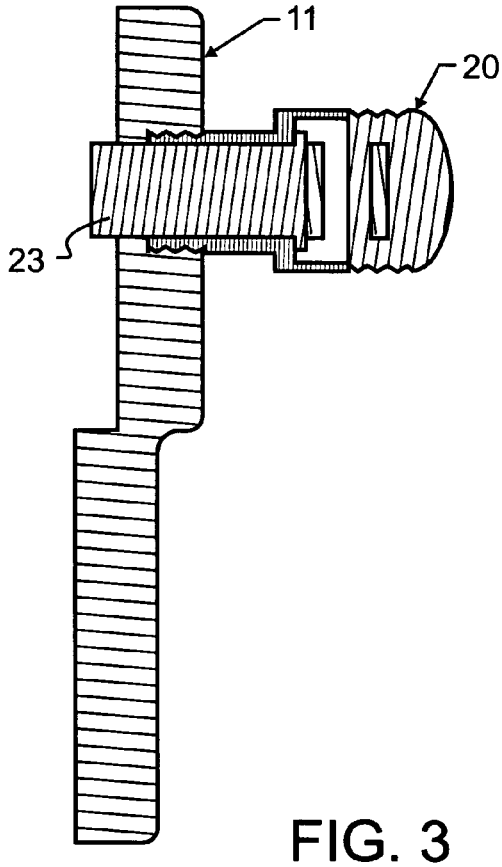
FIG. 3 illustrates the first alternative embodiment pin of FIG. 2 in further combination with an attachment plate from cross-sectional view.

An alternative embodiment pin 20 similar to preferred embodiment pin 10 is illustrated in FIG. 2, and a combination pin 20 and plate 11 in FIG. 3, each figure showing by cross-sectional view the internal construction. Body member 33 has external threading 27 adjacent a first end and also has internal threading 31 distal thereto. The external threads 27 are most preferably designed to engage a bore formed into the barrel of a paint ball gun or a plate adjacent thereto, similar to bore 18 of FIG. 1, and seal securely therewith. The internal threads 31 are designed to engage with external threads 29 on cap 22. The orientation of threads, and even the specific use of threads instead of other methods of attachment, will be determined by a suitably skilled designer for a specific application. While the preferred arrangements of internal and external threading are shown herein, those skilled in the art will recognize that different arrangements may be made, and that other types of connectors selected from the myriad of possible connectors are considered to be included herein.

As illustrated, cap 22 carries a magnet 25 therein, preferably of the rare earth type as already described with regard to pin 10. A plunger 23 is provided within a bore in body member 33 and reciprocates therein. At an end of plunger 23 adjacent cap 22 is a rare earth magnet 24 similar to magnet 25. Most preferably, these magnets 24, 25 will have like poles facing each other, which causes the magnets to repel each other. In turn, plunger 23 will be driven away from cap 22 and into the paint ball gun barrel bore. When properly dimensioned, plunger 23 will extend sufficiently into the barrel bore to interfere with a minimally dimensioned paint ball, and thereby prevent the paint ball from passing through the barrel beyond pin 20.

Figure 4:
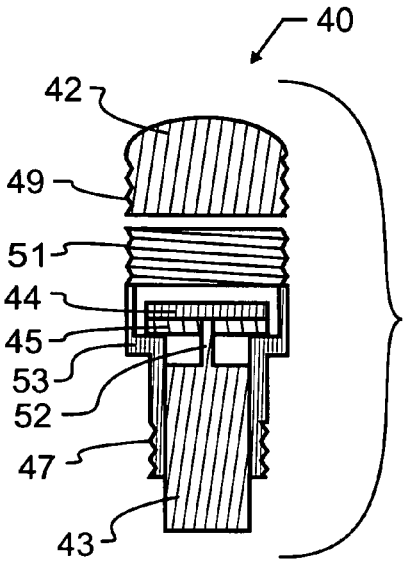
FIG. 4 illustrates a second alternative embodiment barrel indexing pin designed in accord with the teachings of the present invention from cross-sectional view.

FIG. 4 illustrates a second alternative embodiment pin 40, having similar features and function to pin 20 evidenced by reference numerals which carry identical ones digits, and with the number only increased by twenty. So, for example, cap 42 of pin 40 has like feature and function to cap 22 of pin 20. However, the following specifically noted components have different features and function. In pin 40, rather than using a "push-push" orientation for magnets 24, 25, magnets 44, 45 are arranged in a "pull-pull" orientation. Magnet 45 is a ring magnet, which has a cylindrical neck 52 of plunger 43 passing through its center opening. Magnet 45 is most preferably fixedly attached to body 53. Adjacent to magnet 45, but on a face opposed to plunger 43, is magnet 44. Most preferably, magnets 44 and 45 are arranged with opposed poles facing each other. In this configuration, magnets 44 and 45 will pull towards each other, thereby tending to drive plunger 43 extended into the barrel bore. While the illustrated "pull-pull" configuration is contemplated herein, and offers some of the advantages of the "push-push" operation, one important benefit is lost by this arrangement. When the magnets are oriented as shown, the magnetic force holding plunger 43 within the bore is the greatest with plunger 43 fully in the bore. In other words, to overcome the plunger and push past, a paint ball will encounter the greatest force upon initial contact therewith. Once magnets 44, 45 start to separate, the force will drop exponentially. In other words, it may be difficult to keep the forces encountered by the paint ball to a minimum, while still retaining sufficient return force to bring plunger 43 back to the indexing position once magnets 44 and 45 have been separated.

As may be evident from FIG. 1, a directionally oriented surface on plungers 13, 23, 43 may be presented to the paint ball. In such case, the movement of the plunger may be optimized. If desired, some mechanism may be provided to ensure proper orientation, including but not limited to scribe marks in the body member, thread stops, or other suitable mechanism. As indicated, FIG. 1 illustrates but one possible embodiment for the geometry, and other shapes may be provided for the plunger which are suited for a given application.

Figure 5:
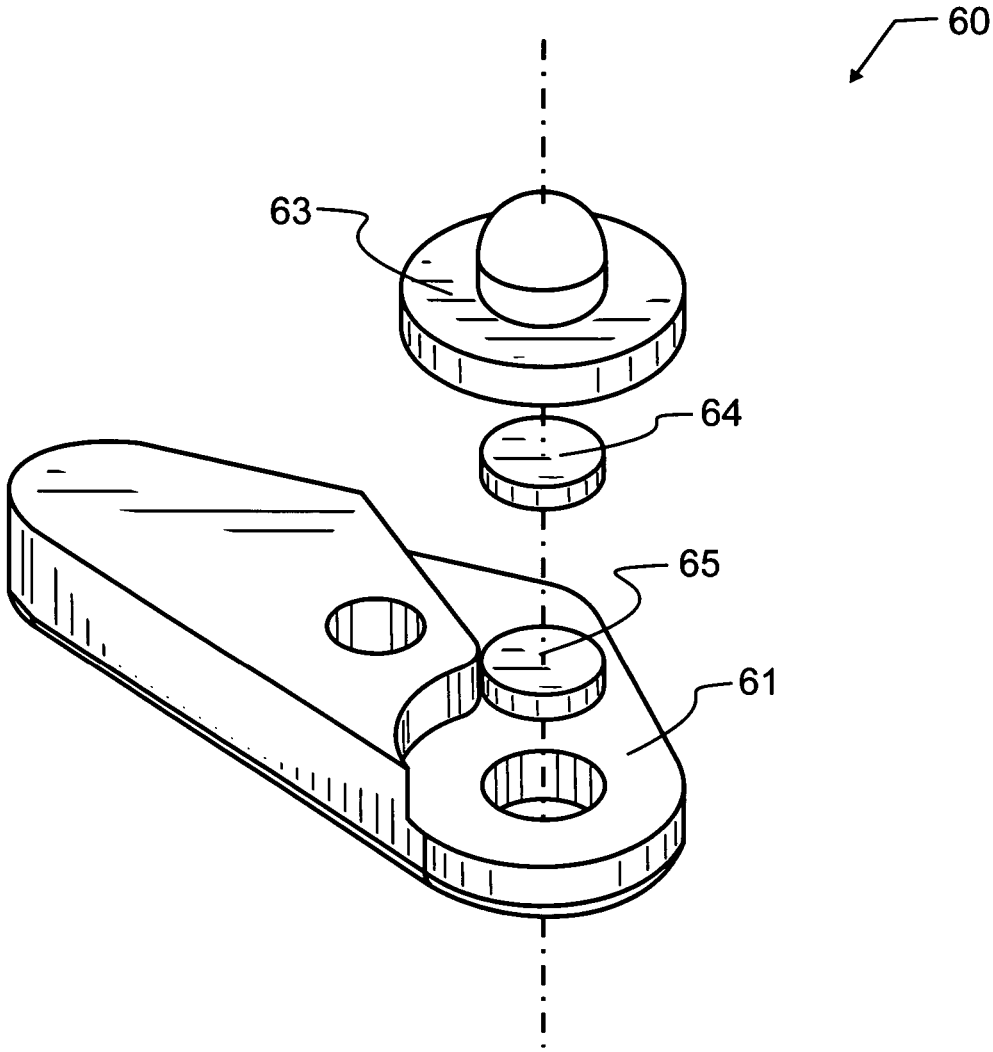
FIG. 5 illustrates a third alternative embodiment barrel indexing pin designed in accord with the teachings of the present invention in further combination with an attachment plate, from an exploded and projected assembly view.

FIG. 5 illustrates a third alternative embodiment pin 60 in combination with plate 61. In this exemplary embodiment, magnet 65 is inserted, formed into or otherwise affixed to plate 61, while magnet 64 is coupled for movement with plunger 63. In this figure, plate 61 acts to keep plunger 63 coupled to the gun barrel, and the gun barrel will serve as the other limit to the range of travel. In contrast, in pin 10, cap 16 acted as one limit, while plate 11 served as the other. Cap 63 also has a dome shaped protrusion for engaging a paint ball, in contrast to the sloped blade of plunger 13. The dome shaped plunger 63, being symmetrical, is independent of orientation within the barrel.

From the foregoing descriptions and illustrations, it will be apparent that the preferred and alternative embodiment pins may be used in other applications requiring the benefit afforded by the embodiments, and so it is contemplated herein that the teachings of the present invention are not solely limited to paint ball gun barrels and may find additional appropriate application.

Figure 6:
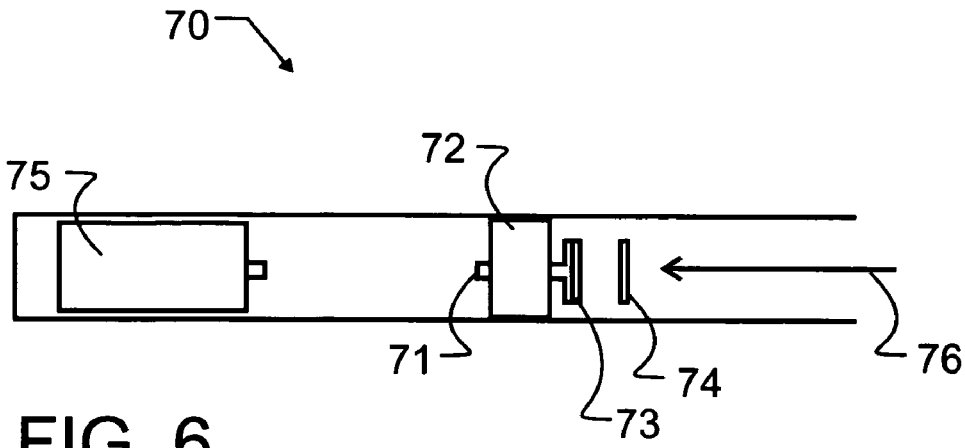
FIG. 6 illustrates a preferred embodiment valve and hammer designed in accord with the teachings of the present invention from cut-away schematic view.
Figure 15:
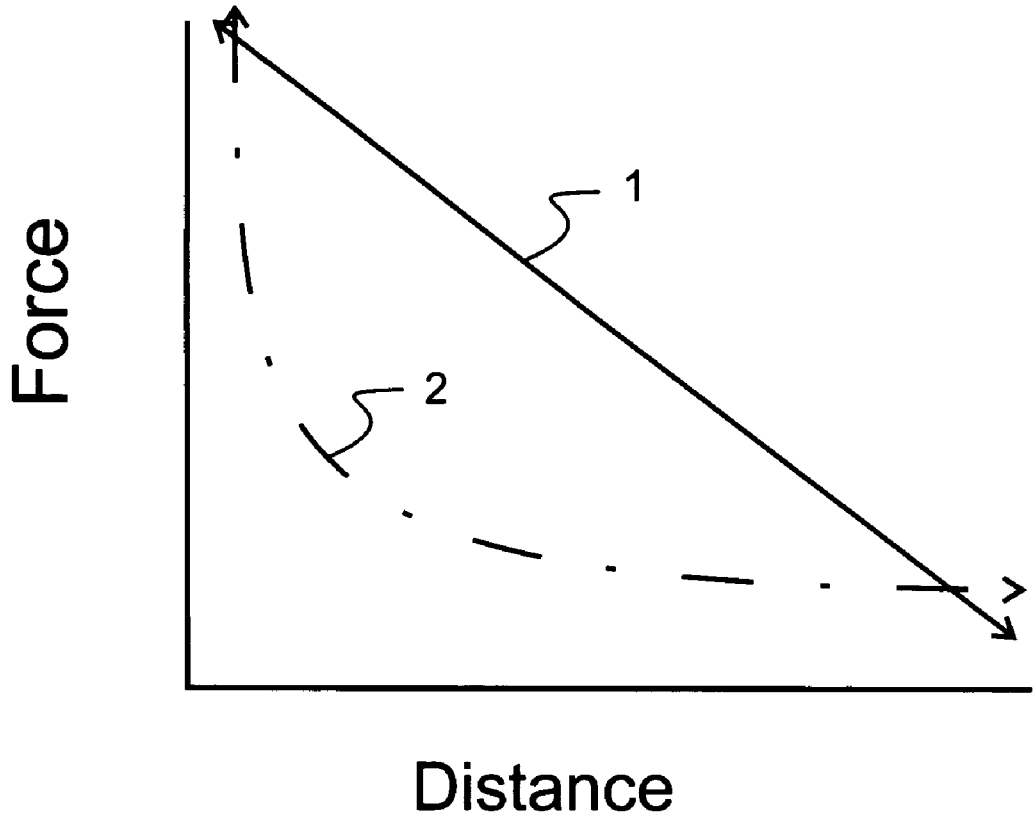
FIG. 15 illustrates the force with respect to distance curves for prior art springs and for magnetic coupling of the present invention.

FIG. 6 illustrates a preferred embodiment valve and hammer 70 designed in accord with the teachings of the present invention from cut-away schematic view. As illustrated therein, a first magnet 73 is attached to an inactive face of valve 71, and is in opposition to magnet 74, which is anchored in position. The repulsion between magnets 73, 74 maintains valve 71 closed against valve seat 72, until hammer 75 strikes valve 71. The non-linear magnetic function permits the valve to be opened with less force than a spring counterpart, more quickly owing to the lower initial force, is limited in range by a greater force than a spring counterpart, and may in turn offer more consistency and less recoil from shot to shot. It will be understood that the references to greater and less force are dependent upon the spring constants, magnet strengths and the like, and that it is already contemplated that a relatively weaker spring may permit the spring to have an equally or even lesser initial force. However, in such case, the peak force of the spring, which operates from a linear force vs. distance curve 1 as shown in FIG. 15, will be substantially less than the force from the magnet pair, which operates with a square function of force versus distance, shown in FIG. 15 as curve 2.

While less preferred, magnets 73 and 74 could in another conceived of alternative embodiment be arranged to have opposite poles facing each other. In such case, the valve and magnets must be sized and shaped to permit the air pressure to close the valve, while the magnets accelerate movement of the valve making it open in a quicker fashion than without the magnets.

Figure 7:
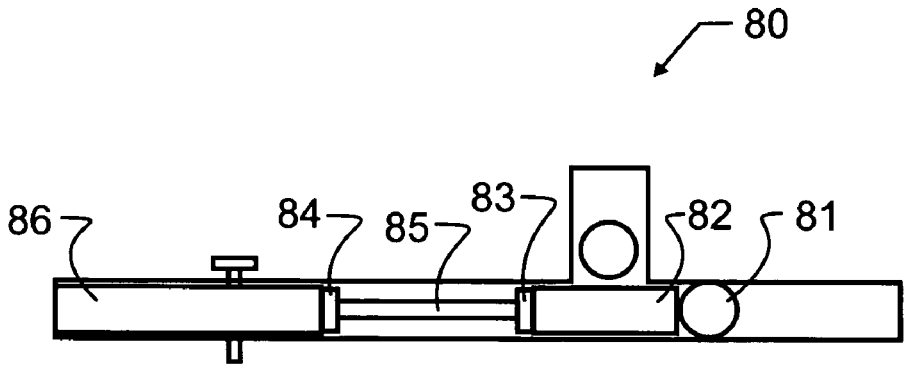
FIGS. 7 and 8 illustrate a preferred embodiment bolt designed in accord with the teachings of the present invention in two alternative positions from schematic side plan view.
Figure 8:
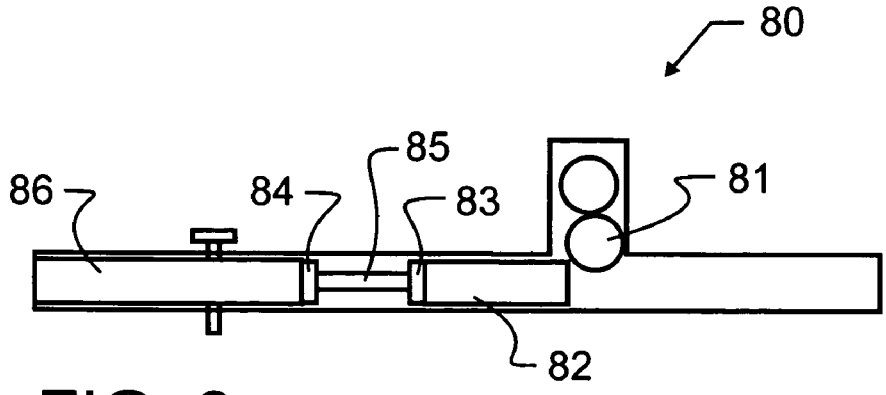

FIGS. 7 and 8 illustrate a preferred embodiment bolt 80 designed in accord with the teachings of the present invention in two alternative positions from schematic side plan view. With like poles facing each other, the forces are minimal until the two magnets 83, 84 are adjacent each other, allowing a lower initial force to be placed upon ball 81 at the time of first contact, thereby preventing ball breakage better than in the prior art. Said another way, the initial impact of bolt face 82 onto ball 81 will preferably be gentler than with a standard spring. As shown in FIG. 7, if paint ball 81 has not dropped fully into the gun barrel when bolt 86 is activated, bolt face 82 may slide upon rod 85 and bring the two magnets 83, 84 closer together, again with less chance of damaging ball 81 than in the prior art. In this case, the air burst into the breech will be discharged without firing a ball, and the pinched ball 81 of FIG. 8 will then enter the breech to be fired on the next cycle.

Figure 9:
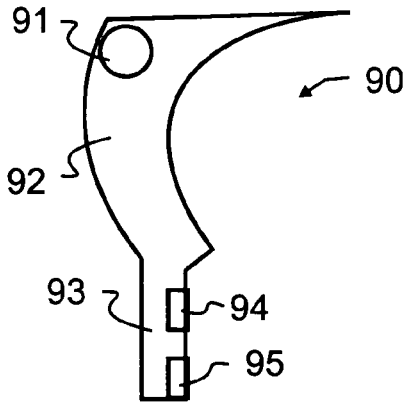
FIG. 9 illustrates a preferred embodiment trigger receiver designed in accord with the teachings of the present invention from side view.
Figure 10:
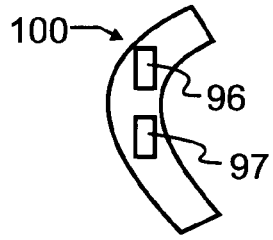
FIGS. 10-14 illustrate preferred embodiment trigger faces designed in accord with the teachings of the present invention from side view.
Figure 11:
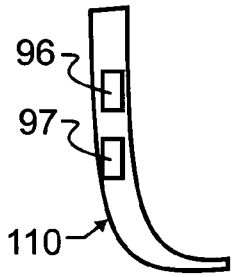
Figure 12:
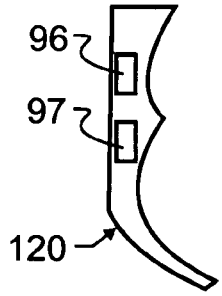
Figure 13:
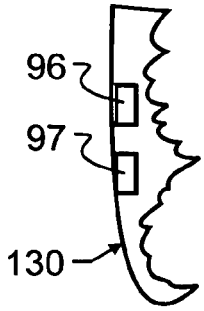
Figure 14:
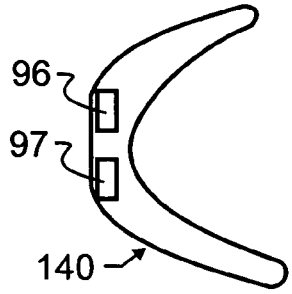

The foregoing embodiments illustrate several different and independent situations which use the non-linear force function of magnetic coupling for synergistic benefit within a paint ball gun. These applications each benefit from the non-linear curve 2 illustrated in FIG. 15. However, there is an additional application for magnetic coupling which is of particular benefit to the owner of a paint ball gun, and which is illustrated by FIGS. 9-14. FIG. 9 illustrates a trigger receiver 90, which has a body member 92 having a general L shape, with a hole 91 designed to receive a roller bearing there through. Adjacent a shaft 93 terminating body 92 are a pair of magnets 94, 95. While a pair of magnets are illustrated, and will be discussed as a pair, it will become apparent to those skilled in the art that any number of magnets may be used. As the numbers of magnets are increased, so typically is the manufacturing cost. Further, a single long magnet may suffice for the purposes of the following discussions. Consequently, it will be recognized that one or more magnets may be used, with two being the most preferred. Most preferably, shaft 93 carrying magnets 94 and 95 will fit within a paint ball gun trigger groove, and will additionally support thereon and within the trigger groove one of the trigger faces 100, 110, 120, 130, or 140 illustrated in FIGS. 10-14. Since shaft 93 fits within a paint ball gun trigger groove with a trigger face, any one of the trigger faces 100, 110, 120, 130, or 140 may be coupled to shaft 93. Complementary to magnets 94, 95 on shaft 93 are magnets 96, 97, which are arranged to have opposite poles than the poles on facing surfaces of magnets 94, 95. In other words, magnets 94, 95 are arranged with poles attracted to the poles of magnets 96, 97. Consequently, if a gun owner or user wishes to change triggers, the change is simply a matter of prying apart magnets 94, 95 from magnets 96, 97, with the insertion of a new trigger leading to magnetic coupling therebetween. This ready replacement, which avoids the disassembly and reassembly required of prior art guns to change triggers, permits guns to be sold with or later provided with a myriad of triggers, simply based upon the owner's or user's preference.

From these figures discussed herein above, several additional features and options become more apparent. First of all, the preferred and alternative embodiments may be manufactured from a variety of materials, including metals, resins and plastics, ceramics or cementitious materials, special alloys, or even combinations of the above. The most preferred materials for the embodiments of the present invention will not adversely interfere with or short circuit the magnetic paths which permit proper operation, and may, where desired, be designed to enhance the magnetic circuit.

A variety of designs have been contemplated for each of the embodiments illustrated herein, and will generally be configured to correspond to a particular manufacturer's gun geometries. The materials used for a particular design may be chosen not only based upon factors such as magnetic characteristic and weight, but may also factor in the particular design.

While the foregoing details what is felt to be the preferred and additional alternative embodiments of the invention, no material limitations to the scope of the claimed invention are intended. The variants that would be possible from a reading of the present disclosure are too many in number for individual listings herein, though they are understood to be included in the present invention. For exemplary purposes only, and not limited solely thereto, in the preferred embodiments the magnets are disclosed in pairs that are either attractive or repulsive as a pair. However, those skilled in the art of magnets and magnetic fields will recognize that for magnetically attractive pairs it is not necessary to use two magnets. Instead, one material may be magnetic, while the second material may only be magnetically susceptible, such as soft iron or the like. As already aforementioned with regard to FIG. 1, but certainly applicable to all embodiments, it is further possible to use and actively substitute a plurality of magnets rather than just two magnets, or magnets of different and selectable characteristics, in a particular embodiment. Therefore, features and design alternatives that would be obvious to one of ordinary skill in the art upon a reading of the present disclosure are considered to be incorporated also. The scope of the invention is set forth and particularly described in the claims herein below.

I claim:

1. A paint ball gun barrel indexing pin cooperative with an indexing hole that extends radially through a paint ball gun breech wall and into an axial bore, said axial bore defining at least in part a paint ball pathway through said paint ball gun breech and into a paint ball gun barrel, comprising:

a plunger passing within said indexing hole and variable in position relative to said indexing hole;

a cover retaining said plunger within said indexing hole and thereby defining a first limit of travel of said plunger at which said paint ball will pass through said paint ball pathway into said paint ball gun barrel;

a body retaining said plunger within said indexing hole and thereby defining a second limit of travel of said plunger that is distal to said first limit of travel and at which said paint ball is restricted from passing from said breech to said barrel;

a first magnet coupled to said cover; and a second magnet coupled to said plunger;

said first and second magnets repelling said plunger from said cover towards said second limit of travel with a force when said plunger is at said second limit of travel at a minimum and non-linearly increasing from said minimum when said plunger travels from said second limit toward said first limit so as to have less force at said first limit than if said force increased linearly, and to thereby reduce the force required to displace said plunger from said second limit to said first limit.

2. The paint ball gun barrel indexing pin of claim 1, wherein said cover is removably affixed to said body.

3. The paint ball gun barrel indexing pin of claim 2, wherein said cover is threaded into said body.

4. The paint ball gun barrel indexing pin of claim 3, wherein threading said cover into said body increases said force repelling said plunger from said cover.

5. The paint ball gun barrel indexing pin of claim 4, further comprising a third magnet removably inserted into said cover, whereby said force repelling said plunger from said cover is increased through insertion of said third magnet and decreased by removal of said third magnet.

6. The paint ball gun barrel indexing pin of claim 1, further comprising an adjustable magnitude of magnetic repulsion between said cover and said plunger.

7. The paint ball gun barrel indexing pin of claim 6, further comprising a third magnet removably inserted into said cover, whereby said force repelling said plunger from said cover is increased through insertion of said third magnet and decreased by removal of said third magnet.

8. The paint ball gun barrel indexing pin of claim 1, wherein said first magnet has a first pole exposed to and facing towards said plunger, and said second magnet has a first pole of like polarity to said first magnet pole and facing towards said cover.

9. A paint ball gun barrel detent pin cooperative with an indexing hole that extends radially through a paint ball gun breech wall and into an axial bore, said axial bore defining at least in part a paint ball pathway through said paint ball gun breech and into a paint ball gun barrel, comprising:

a plunger passing within said indexing hole and variable in penetration into said axial bore;

a cover retaining said plunger within said indexing hole and thereby defining a first limit of travel of said plunger having a minimum penetration into said axial bore, said plunger at said first limit and during a firing of said paint ball gun permitting said paint ball to pass through said paint ball pathway into said paint ball gun barrel without fracture;

a body retaining said plunger within said indexing hole and thereby defining a second limit of travel of said plunger that is distal to said first limit of travel, said plunger at said second limit of travel having a maximum penetration into said axial bore and thereby restricting said paint ball from passing from said breech to said barrel;

a first magnet coupled to said cover; and a second magnet coupled to said plunger;

said first and second magnets repelling said plunger from said cover towards said second limit of travel with a force when said plunger is at said second limit of travel at a minimum and non-linearly increasing from said minimum when said plunger travels from said second limit toward said first limit so as to have less force at said first limit than if said force increased linearly, and to thereby reduce the force required to displace said plunger from said second limit to said first limit.

10. The paint ball gun barrel detent pin of claim 9, wherein said cover is removably affixed to said body.

11. The paint ball gun barrel detent pin of claim 10, wherein said cover is threaded into said body.

12. The paint ball gun barrel detent pin of claim 11, wherein threading said cover into said body increases said force repelling said plunger from said cover.

13. The paint ball gun barrel detent pin of claim 12, further comprising a third magnet removably inserted into said cover, whereby said force repelling said plunger from said cover is increased through insertion of said third magnet and decreased by removal of said third magnet.

14. The paint ball gun barrel detent pin of claim 9, further comprising an adjustable magnitude of magnetic repulsion between said cover and said plunger.

15. The paint ball gun barrel detent pin of claim 14, further comprising a third magnet removably inserted into said cover, whereby said force repelling said plunger from said cover is increased through insertion of said third magnet and decreased by removal of said third magnet.

16. The paint ball gun barrel detent pin of claim 9, wherein said first magnet has a first pole exposed to and facing towards said plunger, and said second magnet has a first pole of like polarity to said first magnet pole and facing towards said cover.

* * * * *